United States Patent [19]

Baghdadi

[11] 3,936,223

[45] Feb. 3, 1976

[54] COMPRESSOR DIFFUSER

[75] Inventor: Samy Baghdadi, Indianapolis, Ind.

[73] Assignee: General Motors Corporation, Detroit, Mich.

[22] Filed: Sept. 23, 1974

[21] Appl. No.: 508,352

[52] U.S. Cl. ..... 415/211; 415/207

[51] Int. Cl.[2] ..... F04D 29/44

[58] Field of Search ..... 415/207, 211, 186, 185, 415/184

[56] References Cited

UNITED STATES PATENTS

| | | | |
|---|---|---|---|
| 978,397 | 12/1910 | Rice | 415/186 |
| 1,056,689 | 3/1913 | Kieser | 415/211 |
| 1,075,300 | 10/1913 | Moss | 415/186 |
| 2,114,285 | 4/1938 | Berger | 415/211 |
| 2,819,012 | 1/1958 | Atkinson | 415/211 |
| 3,333,762 | 8/1967 | Vrana | 415/186 |

FOREIGN PATENTS OR APPLICATIONS

| | | | |
|---|---|---|---|
| 240,004 | 10/1911 | Germany | 415/211 |
| 699,743 | 12/1940 | Germany | 415/211 |

*Primary Examiner*—Henry F. Raduazo
*Attorney, Agent, or Firm*—Paul Fitzpatrick

[57] ABSTRACT

A diffuser for a radial-flow compressor with a circumferentially and radially extending annular splitter plate dividing the entrance portion of each diffusing passage into two parallel passages.

2 Claims, 3 Drawing Figures

COMPRESSOR DIFFUSER

My invention relates to centrifugal compressors, and particularly to diffusers of such compressors. In a centrifugal compressor, the rotor receives air and accelerates it, discharging the air with high tangential and radial components of velocity. The air then flows through a diffuser in which the kinetic energy or velocity head is transformed into pressure head by deceleration of the flow in diverging passages. Such compressors are employed for various purposes, including turbochargers and small gas turbine engines.

The design of a suitable diffuser becomes more difficult when the compressor has a widely varying cycle of operation; the reason being that the direction of flow and velocity of flow from the rotor varies with operating conditions. While it is relatively easy to design a diffuser for constant inlet and outlet conditions, variations in the nature of the flow greatly increase the difficulty of providing a satisfactory diffuser. It is difficult to provide a diffuser which is relatively efficient over a wide operating spectrum but does not sacrifice too much efficiency at any given operating point.

With fixed vanes in the diffuser, the angle of attack of the flow to the leading edge of the vanes will vary with operating conditions, and flow separation and attendant instability (surging) may result under some conditions of operation with attendant inefficiency.

Build-up of boundary layer along the walls of diffuser passages is also considered undesirable as causing flow losses and thereby a decrease in efficiency of the compressor.

My invention is directed to providing a splitter in the entry portion of the diffuser passages which effectively divides each passage into two passages bounded respectively by the forward wall of the diffuser and the splitter, and by the rear wall of the diffuser and the splitter. The result of this is an increase in boundary layer because of the additional surface of the passage over which the air flows. The additional wall area has the effect of reducing flow separation and providing more uniform diffusion over a wider flow range. The increase in losses due to boundary layer thickening are more than offset by the reduction in flow separation losses, providing improved diffuser efficiency over a wider range of flow rates.

The principal objects of my invention are to provide a compressor having a wider efficient flow range than standard compressors, to provide an improved diffuser for a centrifugal compressor which provides improved efficiency over a wide flow range without the inclusion of variable geometry, and to provide a diffuser which lessens flow separation in the diffuser passage by increasing boundary layer effects.

The nature of my invention and its advantages will be apparent to those skilled in the art from the succeeding detailed description of the preferred embodiment of the invention, the accompanying drawings thereof, and the appended claims.

Referring to the drawings, FIG. 1 is an illustration of a centrifugal compressor taken principally in a plane containing the axis of rotation of the compressor rotor.

Figure 1:
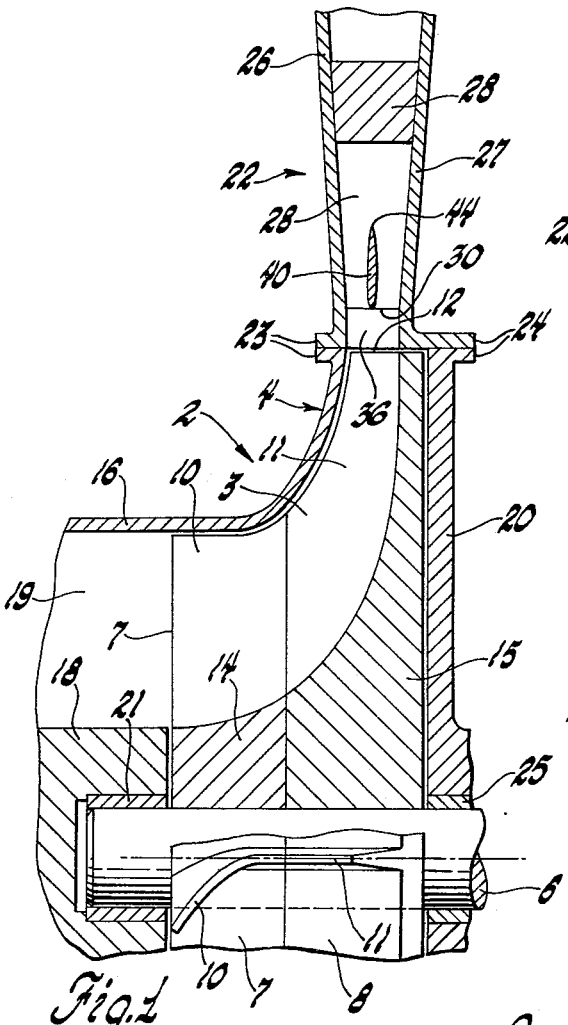

FIG. 1 illustrates a compressor 2 including a rotor 3 and a stator 4. The rotor is mounted on shaft 6 which may be driven by any suitable source of power. The rotor comprises an inducer portion 7 and an impeller portion 8 suitably fixed to shaft 6. The inducer has forwardly curved vanes 10 to promote smooth entry of the gas, hereinafter referred to as "air", into the impeller. The impeller has radial vanes 11 distributed around its circumference which accelerate the air outwardly and circumferentially and discharge it from the tips of the impeller blades at the periphery 12 of the rotor.

The inducer blades 10 extend from a hub 14 and the impeller blades 11 from a disk 15, both of which are fixed to shaft 6.

The stator structure 4 includes an outer shroud or front plate 16 and a shaft support 18 fixed centrally of the shroud 16. These define an air entrance 19 into the rotor. The support 18 may be suitably fixed to the outer shroud 16. The stator also includes a back plate 20 and a diffuser 22. The shroud 16 and back plate 20 may be fixed together by the diffuser 22 to which they may be joined at cylindrical joining flanges 23 and 24.

The shaft 6 may be supported in a bushing 21 in the support 18 and a bushing 25 in the back plate 20. The blades 10 and 11 extend from the hub 14 and disk 15 into close proximity to the shroud 16.

The rotor structure as so far described is merely illustrative of the environment of the invention, and may follow known principles of design. Specifically, it may, if desired, be of the type described in Atkinson U.S. Pat. No. 2,819,012 issued Jan. 7, 1958.

Proceeding now to the structure of diffuser 22, this includes a front wall 26 and a rear wall 27 which extend generally radially from the joining flanges 23 and 24 and may diverge in the radially outward direction as illustrated. The diffuser also includes an annular array of vanes 28 extending radially and tangentially from the rotor and extending from the front wall 26 to the rear wall 27. Vanes 28 may be integral with one wall, or part of each may be integral with each wall, or the vanes may be bolted or otherwise fixed to both walls. As illustrated, the vanes are wedge-shaped with flat surfaces, but the vanes may be curved if desired. The leading edges 30 of the vanes are disposed on a cylindrical surface spaced radially from the impeller periphery 12. This radial spacing may vary, depending upon the desired characteristics of the installation. Some space is necessary, and it is considered desirable in some cases to have a substantial vaneless space between the impeller periphery 12 and the leading edges of the vanes.

An annular array of diffusing passages 32 are defined between the front and rear walls and the confronting surfaces of the vanes 28. As illustrated, diffusing passages 32 have straight centerlines. However, the vanes and diffuser passages may be curved, such as of a generally spiral shape, or other suitable curvature as required by the installation.

Figure 3:
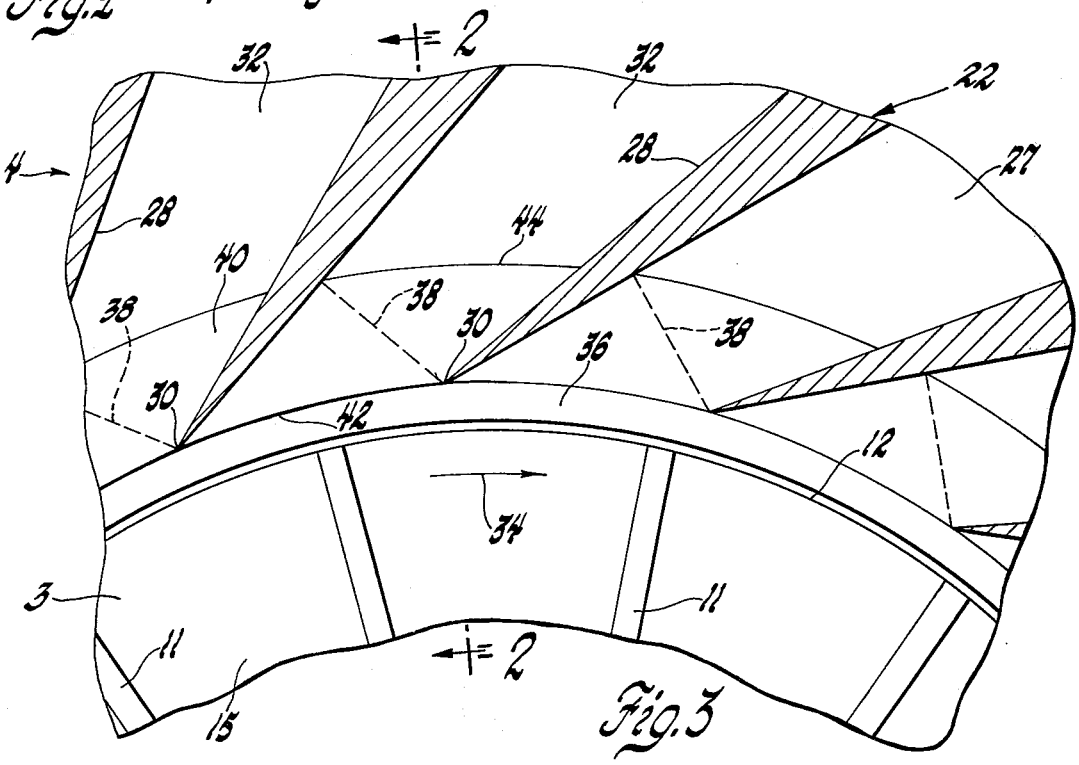
FIG. 3 is a partial transverse sectional view of the compressor taken on the planes indicated by the line 3—3 in FIG. 2.

The rotor rotates clockwise as illustrated in FIG. 3 and indicated by the arrow 34. The vanes are so disposed that the air discharged from the rotor enters between the vanes with a suitable incident angle so that there is no stalling or flow separation as the flow encounters the leading edges of the diffuser vanes. The angle of flow of the air will vary, however, with operating conditions such as rotational speed of the compressor and resistance to flow downstream of the compressor. Air discharged from the compressor rotor thus flows through the vaneless space 36 between the periphery of the impeller and the leading edges 30 of the vanes 28, and to a throat indicated by the dotted line 38 at the entrance to each passage. The throat is defined by a plane extending from the leading edge of each vane perpendicularly to the radially inner surface of the next outward vane, as indicated in FIG. 3. The flow is subsonic through the diffusing passages, although it may be supersonic in the vaneless space.

The diffuser structure so far described may be considered to be conventional. With this introduction, we proceed to my improvement, which lies in the addition of a flow splitter 40 to the diffuser.

Figure 2:
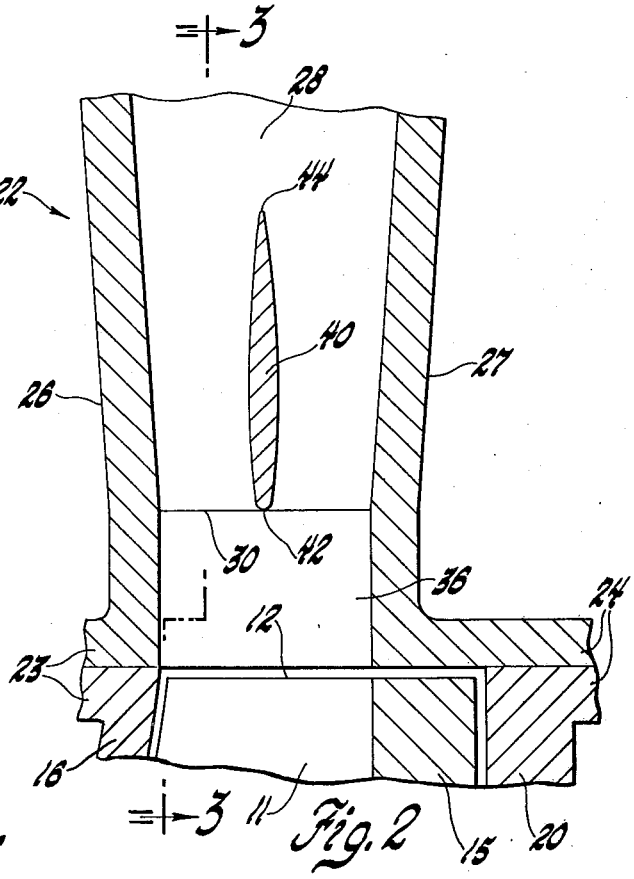
FIG. 2 is an enlarged view of a portion of FIG. 1, taken on the plane indicated by the line 2—2 in FIG. 3.

In its preferred form, the flow splitter 40 is a ring concentric with the axis of rotation of the impeller disposed in slots in the vanes 28. The preferred cross-section is a thin uncambered airfoil section such as that shown most clearly in FIG. 2. The thickness need be only great enough to provide mechanical strength and resist vibration. The inner or leading edge 42 of the flow splitter is preferably at the same radius as the leading edges 30 of the diffuser vanes, and the trailing edge 44 is preferably at the same radius as the outer edges of the throats 38. Some extension beyond these preferred boundaries would be acceptable in most cases. The leading edge 42 of the splitter 40 is disposed at an acute angle to the direction of air flow through the throat, which is substantially perpendicular to the lines 38 and generally aligned with the centerlines of passages 32. The splitter ring 40 may be installed by dividing the diffuser in the central plane so that the forward and rear halves of the diffuser may be mated, with the splitter 40 in the form of a continuous ring disposed between the two halves. Alternatively, the vanes 28 may be solid and have a slot into which the ring 40 may be inserted by radially outward movement. In this case the ring may be made in several sections so that it can be so inserted. Or, if the vanes are assembled to the diffuser walls, they may be mounted around a continuous ring before being bolted in place. Whatever the method of installation, the ring 40 may be brazed or cemented to the vanes if desired. The brazing or cementing material may close any gap between the vanes and the ring between the leading edge 42 and the thickest section to provide a smooth boundary to the flow path.

With the ring 40 in position, the flow through the throat is divided into two paths, one forward and one rearward of the splitter 40. Thus, the air flowing through each diffusing passage 32 is not only in contact with the front and rear walls 26 and 27 and the surfaces of vanes 28, but also with the front and rear surfaces of the splitter 40. This lessens the diffusion at this point, but the additional wall area reduces flow separation and provides for more uniform diffusion over a wider flow range than is the case with a diffuser or equivalent flow area lacking the splitter ring 40. Boundary layer built up along the faces of ring 40 is, of course, swept off at the trailing edge and mixed with the flow proceeding outwardly through the diffuser to the point of discharge. As is well understood, the diffuser passages 32 may terminate in a collector ring or be otherwise directed to a point of use. It should be appreciated that changes in angle of air flow into the diffuser do not adversely affect the flow over the faces of ring 40, since the ring lies in a plane radial to the rotor 3.

The invention may be employed with diffusers other than that specifically shown and described where their operating characteristics are benefitted by inclusion of the splitter.

The detailed description of the preferred embodiment of the invention for the purpose of explaining the principles thereof is not to be considered as limiting or restricting the invention, since many modifications may be made by the exercise of skill in the art.

I claim:

1. A centrifugal compressor comprising, in combination, a rotor operable to discharge gas at high velocity from the periphery of the rotor with radial and tangential components of velocity and a stator enclosing the rotor, the stator including a diffuser disposed around the periphery of the rotor to receive and diffuse the gas discharged from the rotor; the diffuser defining an annular aray of diffusing passages extending radially outwardly and circumferentially from the rotor, at least the downstream portion of each passage being divergent in area in the direction of flow; the passages merging at the entrances to the passages and being discrete at the outlets from the passages; the diffuser including front and rear walls extending generally radially from the periphery of the rotor defining the front and rear boundaries of the diffusing passages and including an annular array of vanes each extending radially and circumferentially from a leading edge and from one said wall to the other, the vanes defining the radially outer and inner boundaries of the diffusing passages; each passage having a throat bounded by the walls, by the leading edge of the vane defining the inner boundary of the passage, and by the inner surface of the vane defining the outer boundary of the passage; in which the improvement comprises an annular flow splitter disposed centrally between the front and rear walls, extending circumferentially across each passage and extending radially through the passage throats, the inner and outer perimeters of the flow splitter being substantially at the inner and outer boundaries of the throats, respectively, the flow splitter dividing the entrance to each diffusing passage into a front passage bounded by the front wall and the splitter and a rear passage bounded by the rear wall and the splitter, so as to reduce flow separation in the diffuser.

2. A centrifugal compressor comprising, in combination, a rotor operable to discharge gas at high velocity from the periphery of the rotor with radial and tangential components of velocity and a stator enclosing the rotor, the stator including a diffuser disposed around the periphery of the rotor to receive and diffuse the gas discharged from the rotor; the diffuser defining an annular array of diffusing passages extending radially outwardly and circumferentially from the rotor, at least the downstream portion of each passage being divergent in area in the direction of flow; the passages merging at the entrances to the passages and being discrete at the outlets from the passages; the diffuser including front and rear walls extending generally radially from the periphery of the rotor defining the front and rear boundaries of the diffusing passages and including an annular array of vanes each extending radially and circumferentially from a leading edge and from one said wall to the other, the vanes defining the radially outer and inner boundaries of the diffusing passages; each passage having a throat bounded by the walls, by the leading edge of the vane defining the inner boundary of the passage, and by the inner surface of the vane defining the outer boundary of the passage; in which the improvement comprises an annular flow splitter having an uncambered airfoil cross-section with its central plane disposed centrally between the front and rear walls, extending circumferentially across each passage and extending radially through the passage throats, the inner and outer perimeters of the flow splitter being substantially at the inner and outer boundaries of the throats, respectively, the flow splitter dividing the entrance to each diffusing passage into a front passage bounded by the front wall and the splitter and a rear passage bounded by the rear wall and the splitter, so as to reduce flow separation in the diffuser.

* * * * *